US010513402B2

(12) United States Patent
Kondou

(10) Patent No.: US 10,513,402 B2
(45) Date of Patent: Dec. 24, 2019

(54) SHEET FEEDING APPARATUS

(71) Applicant: Tsukasa Kondou, Yamanashi-ken (JP)

(72) Inventor: Tsukasa Kondou, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/847,259

(22) Filed: Dec. 19, 2017

(65) Prior Publication Data

US 2018/0179001 A1 Jun. 28, 2018

(30) Foreign Application Priority Data

Dec. 26, 2016 (JP) ..... 2016-251779

(51) Int. Cl.

| | |
|---|---|
| ***B65H 1/18*** | (2006.01) |
| ***B65H 1/04*** | (2006.01) |
| ***B65H 1/14*** | (2006.01) |
| *B65H 7/06* | (2006.01) |

(52) U.S. Cl.

CPC ..... *B65H 1/18* (2013.01); *B65H 1/04* (2013.01); *B65H 1/14* (2013.01); *B65H 7/06* (2013.01); *B65H 2405/15* (2013.01); *B65H 2511/51* (2013.01); *B65H 2511/512* (2013.01); *B65H 2513/512* (2013.01); *B65H 2553/612* (2013.01); *B65H 2601/26* (2013.01)

(58) Field of Classification Search

CPC ..... B65H 1/18; B65H 2511/152; B65H 2553/612; B65H 2553/80; B65H 2553/81; B65H 2553/82; B65H 2553/822; B65H 2553/83

See application file for complete search history.

(56) References Cited

U.S. PATENT DOCUMENTS

| | | | | |
|---|---|---|---|---|
| 5,123,637 A * | 6/1992 | Musaka | G03G 15/6502 | 271/117 |
| 5,897,112 A * | 4/1999 | Kwag | G03G 15/6502 | 271/38 |
| 7,374,163 B2 * | 5/2008 | Cook | B65H 1/00 | 271/145 |
| 7,419,150 B2 * | 9/2008 | Kushida | B42C 1/12 | 270/58.07 |
| 7,971,870 B2 * | 7/2011 | Lee | B65H 7/04 | 271/145 |
| 8,814,159 B2 * | 8/2014 | Kadowaki | B65H 1/14 | 271/94 |
| 9,024,984 B2 * | 5/2015 | Akatsuka | B41J 11/0095 | 271/147 |
| 2015/0284195 A1 * | 10/2015 | Kushida | B65H 1/14 | 271/152 |

FOREIGN PATENT DOCUMENTS

| | | |
|---|---|---|
| JP | 2006-232531 A | 9/2006 |
| JP | 2007-191228 A | 8/2007 |
| JP | 2007-204226 A | 8/2007 |
| JP | 2016-088747 A | 5/2016 |

* cited by examiner

*Primary Examiner* — Jeremy R Severson
(74) *Attorney, Agent, or Firm* — Manabu Kanesaka

(57) ABSTRACT

First and second detecting members that detect a sheet or an object lifted beyond a delivery position at which the sheet is delivered is provided, and the second detecting member is configured to be activated in conjunction with activation of the first detecting member. Thus, with a simple configuration, it is possible to detect, over a wide area above a sheet loading section, a sheet or an object placed at a wrong position.

9 Claims, 10 Drawing Sheets

SHEET FEEDING APPARATUS

BACKGROUND OF THE INVENTION

Field of the Invention

The present invention relates to a sheet feeding apparatus for feeding sheets loaded in a bundle on a loading tray one by one.

Description of the Related Art

As an image formation processing system such as a printer or a copier, there is known a system in which a sheet feeding apparatus is externally mounted to an image processing apparatus. As the sheet feeding apparatus, there is known one configured to successively convey sheets loaded on a loading tray provided in a storage one by one to the image processing apparatus. In the sheet feeding apparatus, the loading tray is lifted to a delivery position at which the upper surface of a sheet bundle on the loading tray contacts a delivery roller, and the sheets are delivered at the delivery position one by one by the delivery roller toward an image forming section.

The sheet feeding apparatus is provided with an upper surface detecting sensor that detects the position of the upper surface of a sheet. Based on a detection result from the upper surface detecting sensor, lifting of the loading tray is controlled such that the uppermost surface of the sheet bundle is moved to the delivery position. Sheets of a various sizes can be loaded on the loading tray. The positions of a sheet side regulating plate and a sheet rear end regulating plate can be moved according to the size of sheets loaded on the loading tray.

When setting small-sized sheets on the loading tray in such a sheet feeding apparatus, a user often erroneously moves the rear end regulating plate to a position different from the rear end position of the small-sized sheets. At this time, the upper surface detecting sensor is disposed at a position corresponding to all sheet sizes, so that if a sheet set position is a position that cannot be detected by the upper surface detecting sensor, the loading tray continues lifting even after the uppermost sheet of the set sheet bundle exceeds the delivery position, with the result that the upper surface of the uppermost sheet runs into a ceiling in the sheet supply apparatus, which may cause damage to the sheet, breakage of parts, or the like.

SUMMARY OF THE INVENTION

First and second detecting members that detect a sheet or an object lifted beyond a delivery position at which the sheet is delivered is provided, and the second detecting member is configured to be activated in conjunction with activation of the first detecting member. Thus, with a simple configuration, it is possible to detect, over a wide area above a sheet loading section, a sheet or an object placed at a wrong position.

BRIEF DESCRIPTION OF THE DRAWINGS

FIGS. 9A to 9D are views each illustrating a sheet state in which FIGS. 9A and 9B illustrate a properly set state, and FIGS. 9C and 9D illustrate a wrongly set state.

DETAILED DESCRIPTION OF THE PREFERRED EMBODIMENTS

Figure 2:
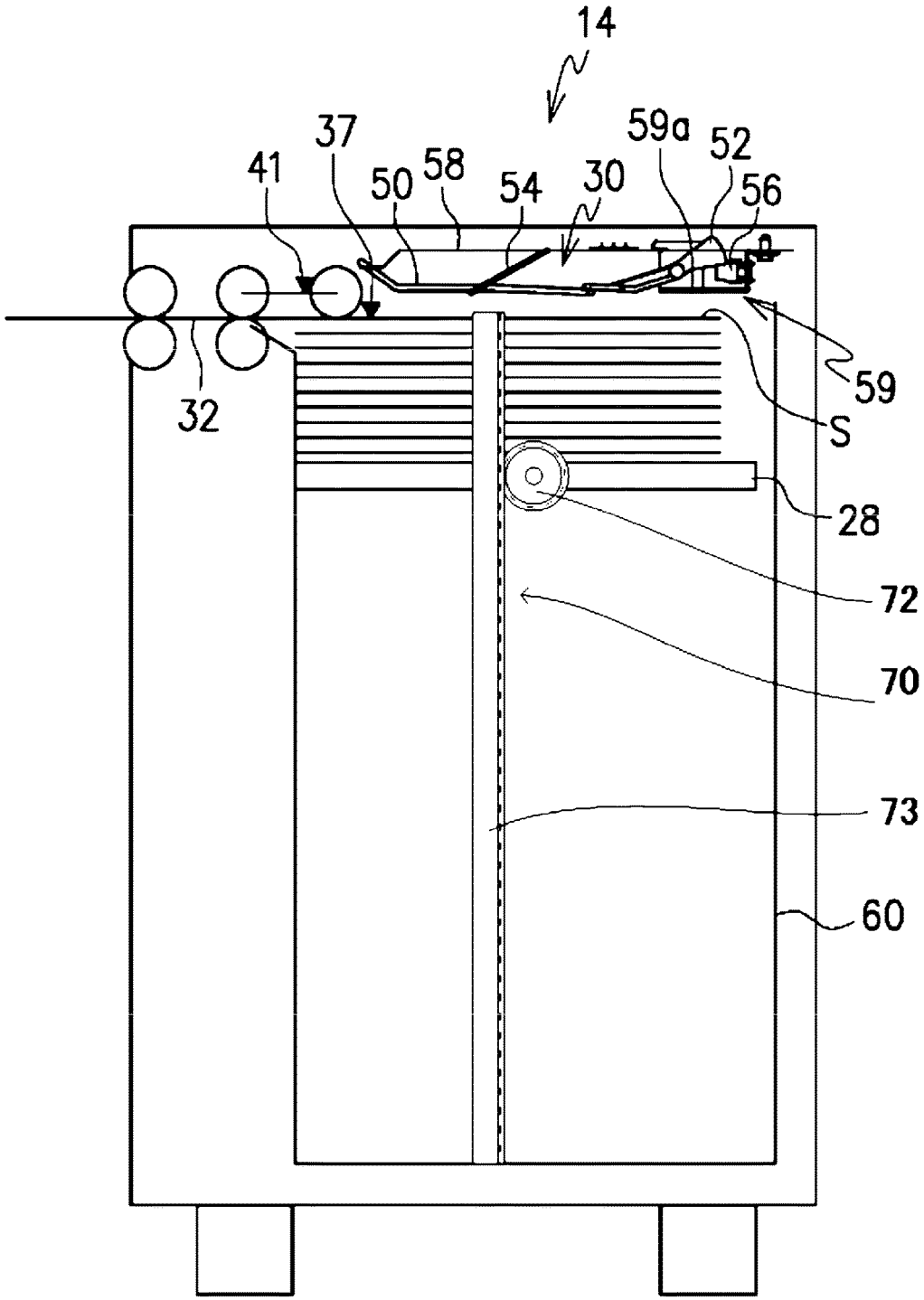
FIG. 2 is a cross-sectional view illustrating the sheet feeding apparatus according to the present invention.

Hereinafter, a sheet feeding apparatus according to the present invention will be described based on an embodiment while referring to the accompanying drawings. The drawings schematically illustrate the sheet feeding apparatus, members constituting the sheet feeding apparatus, and peripheral members of the sheet feeding apparatus, so that actual dimensions and actual dimensional ratios of the members do not necessarily coincide with those in the drawings. Further, unless otherwise specified, the direction (vertical direction, etc.) of the sheet feeding apparatus is defined based on the direction of the sheet feeding apparatus illustrated in FIG. 2. However, the left and right sides of the sheet feeding apparatus illustrated in FIG. 2 are sometimes referred to as the front and rear sides, respectively. Overlapping description will be omitted as needed, and the same reference numerals may be given to the same members.

Figure 1:
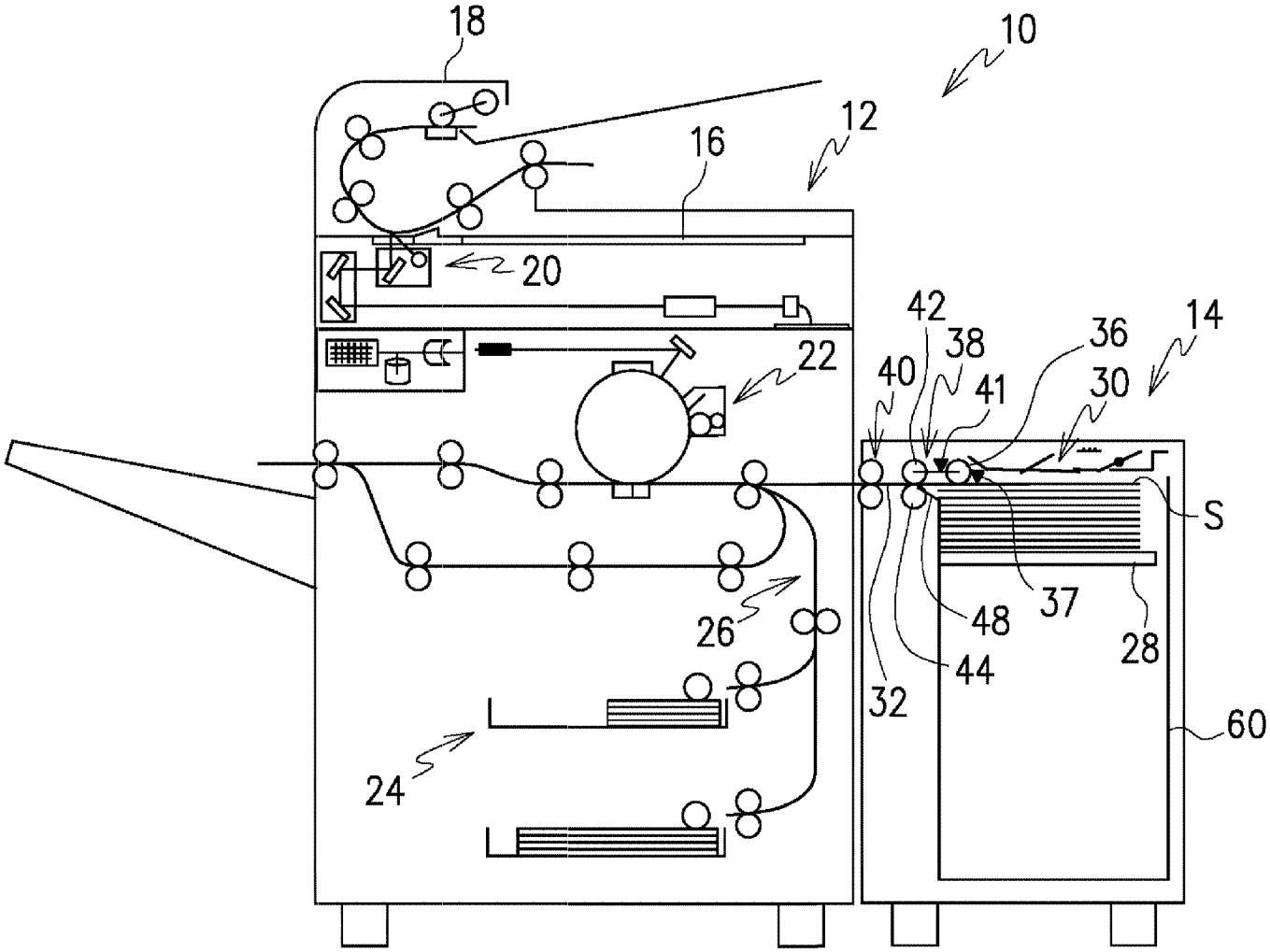
FIG. 1 is a cross-sectional view illustrating an image formation processing system provided with a sheet feeding apparatus according to the present invention.

FIG. 1 is an image formation processing system 10 that can process a large amount of sheets. The image formation processing system 10 includes an image forming apparatus 12 and a sheet feeding apparatus 14 according to the embodiment of the present invention. The image forming apparatus 12 includes a reading mechanism 20 constituted of a platen glass 16 and an ADF (Automatic Document Feeder) 18, an image forming mechanism 22, and a conveying mechanism 26 that feeds a sheet S from a built-in cassette 24 and conveys it.

FIG. 2 illustrates the sheet feeding apparatus 14. The sheet feeding apparatus 14 is an apparatus for successively feeding a large amount of sheets S to the image forming apparatus 12. The sheet feeding apparatus 14 includes a loading tray 28 as a loading section, a lifting mechanism (lifting section) 70 that lifts the loading tray 28, a detecting mechanism 30 that detects an abnormal object (hereinafter, referred to as "foreign matter") in the loading tray 28, and a control section that stops lifting of the loading tray 28 based on a detection signal output from the detecting mechanism 30 when the detecting mechanism 30 has detected the foreign matter.

A sheet bundle composed of a plurality of stacked sheets S is loaded on the loading tray 28. The loading tray 28 is lifted with the sheet bundle loaded thereon by the lifting mechanism. A sheet feed path 32 from the loading tray 28 is connected to the conveying mechanism 26 of the image forming apparatus 12, thereby allowing image formation processing to be carried out. The detecting mechanism (detecting section) 30 is provided above the loading tray 28 and configured to detect a foreign matter in the loading tray 28 during lifting of the loading tray 28. In the present specification, a sheet having a size different from that of a sheet intended to be loaded on the loading tray 28 and a sheet placed in a position different from an appropriate loading position are also included in the foreign matter (abnormal object). That is, not only an object other than the sheet loaded on the loading tray 28, but also the sheet itself can be counted as a foreign matter.

The sheet feeding apparatus 14 includes a sheet feeding section constituted of a delivery roller 36 and a sheet separation mechanism 38 and a conveying roller pair 40. The lifting mechanism 70 is constituted of a pinion 72 provided at a side portion of the loading tray 28 and a rack 73 provided along a side plate of the sheet feeding apparatus 14. The pinion 72 is driven by a lifting motor to be rotated forward and backward, whereby the loading tray 28 is lifted and lowered. In the present embodiment, the lifting mechanism 70 is constituted of the rack 73 and the pinion 72; however, it may have a configuration commonly used. For example, wires may be used to suspend the loading tray. In this case, the wires are attached to the side portion of the loading tray 28, and the wires are wound up to lift the loading tray 28.

When the loading tray 28 is lifted, the uppermost sheet S of the sheet bundle loaded on the loading tray 28 contacts the delivery roller 36 at a delivery position where the sheet S is delivered. When delivery roller 36 is moved up by contact between the sheet S and the delivery roller 36, a delivery position detecting sensor 37 which is a sheet upper surface detecting section provided near the delivery roller and configured to detect the uppermost sheet S of the sheet bundle loaded on the loading tray 28 detects that the uppermost sheet S is located at a predetermined position where it contacts the delivery roller 36, and the control section recognizes the detection. The delivery position detecting sensor 37 is an optical sensor including a light-receiving element and a light-emitting element and is attached to an upper plate 58. The delivery position detecting sensor 37 detects swinging of a flag provided in a holder of the delivery roller 36 to thereby detect the contact between the uppermost sheet S and the delivery roller 36. Based on a detection result from the delivery position detecting sensor 37, the lifting mechanism 70 lifts the loading tray 28 so as to move the uppermost sheet S to the delivery position.

An upper limit detecting sensor 41 is provided at a position higher than the delivery position detecting sensor 37. The upper limit detecting sensor 41 is an optical sensor including a light-receiving element and a light-emitting element and is attached to the upper plate 58 of the apparatus casing. The upper limit detecting sensor 41 detects that the flag provided in the holder of the delivery roller 36 is swung by an upward movement of the delivery roller 36 due to contact between the uppermost sheet S of the sheet bundle loaded on the loading tray 28 and the delivery roller 36. The upper limit detecting sensor 41 prevents breakage of the sheet feeding apparatus 14 due to malfunction of the delivery position detecting sensor 37 or control section. The upper limit detecting sensor 41 detects the uppermost sheet S of the sheet bundle at a position higher than the position of the uppermost sheet S of the sheet bundle detected by the delivery position detecting sensor 37.

The detecting mechanism 30 is disposed above the delivery position and configured to detect a sheet or an object (object other than the sheet) on the loading tray 28. The upper surface position of the sheet at which the delivery roller 36 abuts against the upper surface of the uppermost sheet S is lower than the upper surface position of the sheet S detected by the delivery position detecting sensor 37. The upper surface position of the sheet S detected by the delivery position detecting sensor 37 is lower than the upper surface position (delivery position) of the sheet S to be delivered. The upper surface position (delivery position) of the sheet S to be delivered is lower than the upper surface position of the sheet S detected by the upper limit detecting sensor 41. The upper surface position of the sheet S detected by the upper limit detecting sensor 41 is lower than the upper surface position of a foreign matter detected by the detecting mechanism 30.

The sheet separation mechanism 38 is constituted of a feeding roller 42 and a separating roller 44 and is provided on the upstream side of the sheet feed path 32 directed toward the image forming apparatus 12. In the sheet separation mechanism 38, the sheets S delivered from the loading tray 28 by the delivery roller 36 are pinched one by one by the feeding roller 42 and the separating roller 44 and conveyed toward the conveying roller pair 40. A separation guide plate 48 for guiding the sheet S delivered by the delivery roller 36 between the feeding roller 42 and the separating roller 44 is provided between the delivery roller 36 and the sheet separation mechanism 38.

Figure 3:
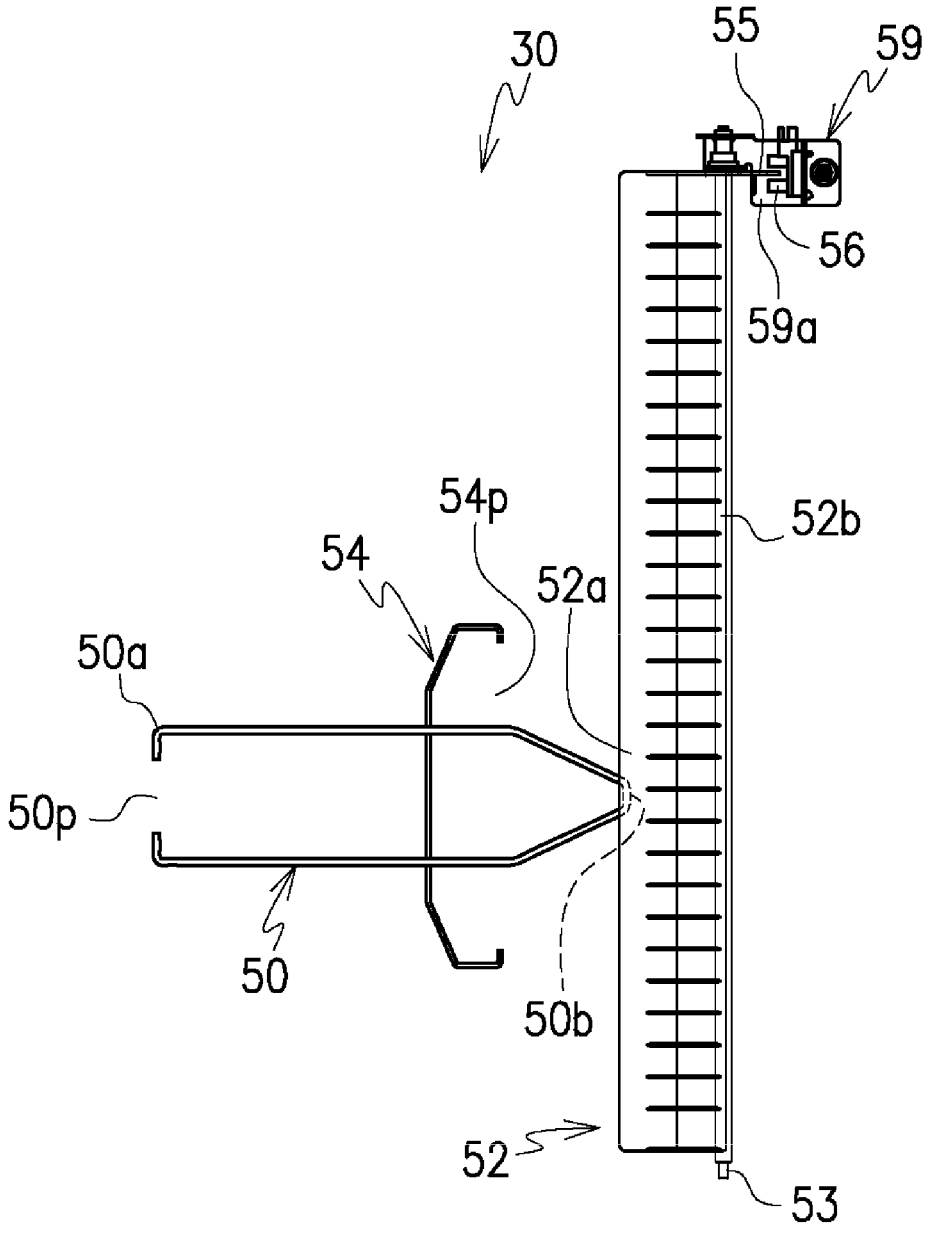
FIG. 3 is a top view illustrating a detecting mechanism in the sheet feeding apparatus according to the present invention.

FIG. 3 is a top view of the detecting mechanism 30. The detecting mechanism 30 is provided above the loading tray 28 and configured to detect a foreign matter F during lifting of the loading tray 28. The detecting mechanism 30 includes a first swing member (first detecting member) 50, a second swing member (second detecting member) 52, a third swing member (regulating member) 54, and a detecting sensor 56.

Figure 4:
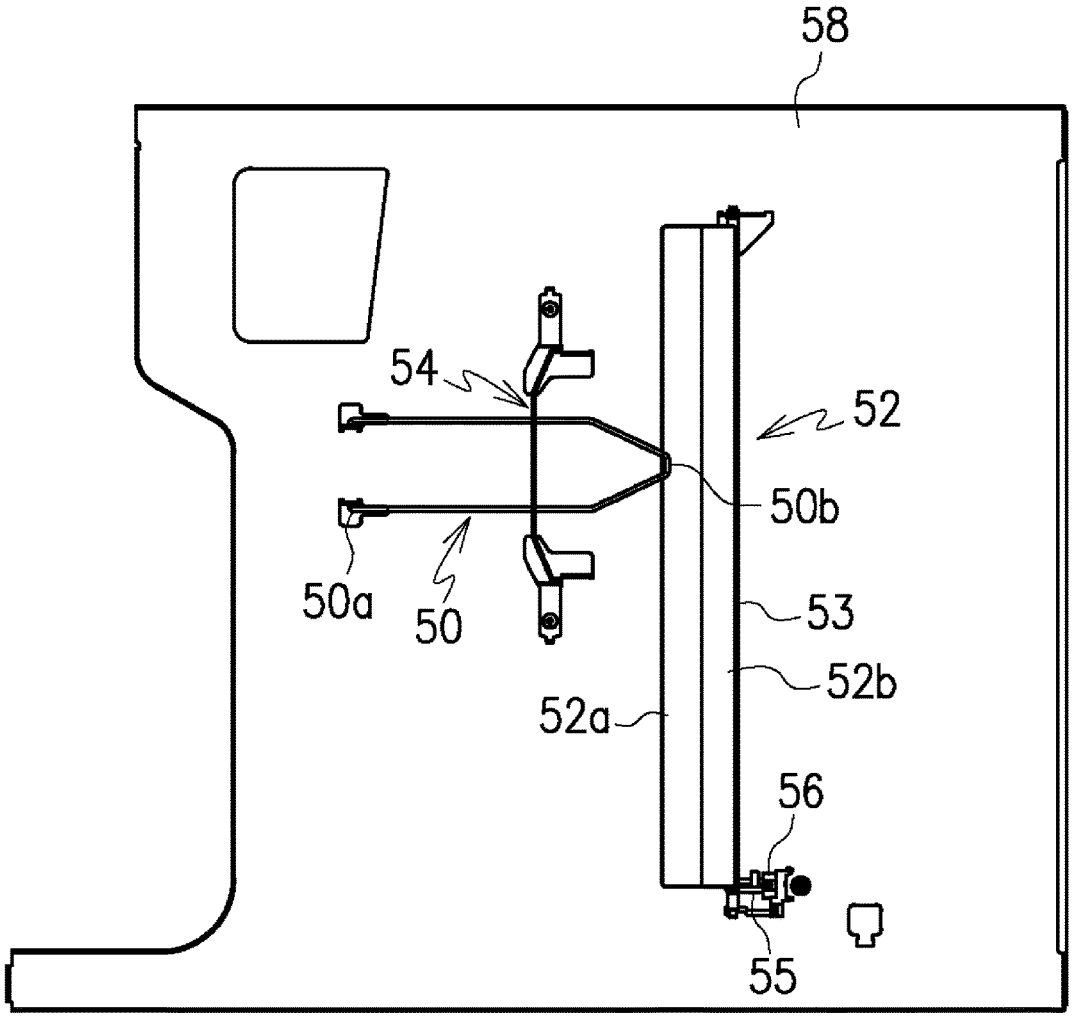
FIG. 4 is a bottom view illustrating an upper plate on which the detecting mechanism in the sheet feeding apparatus according to the present invention is provided.
Figure 5:
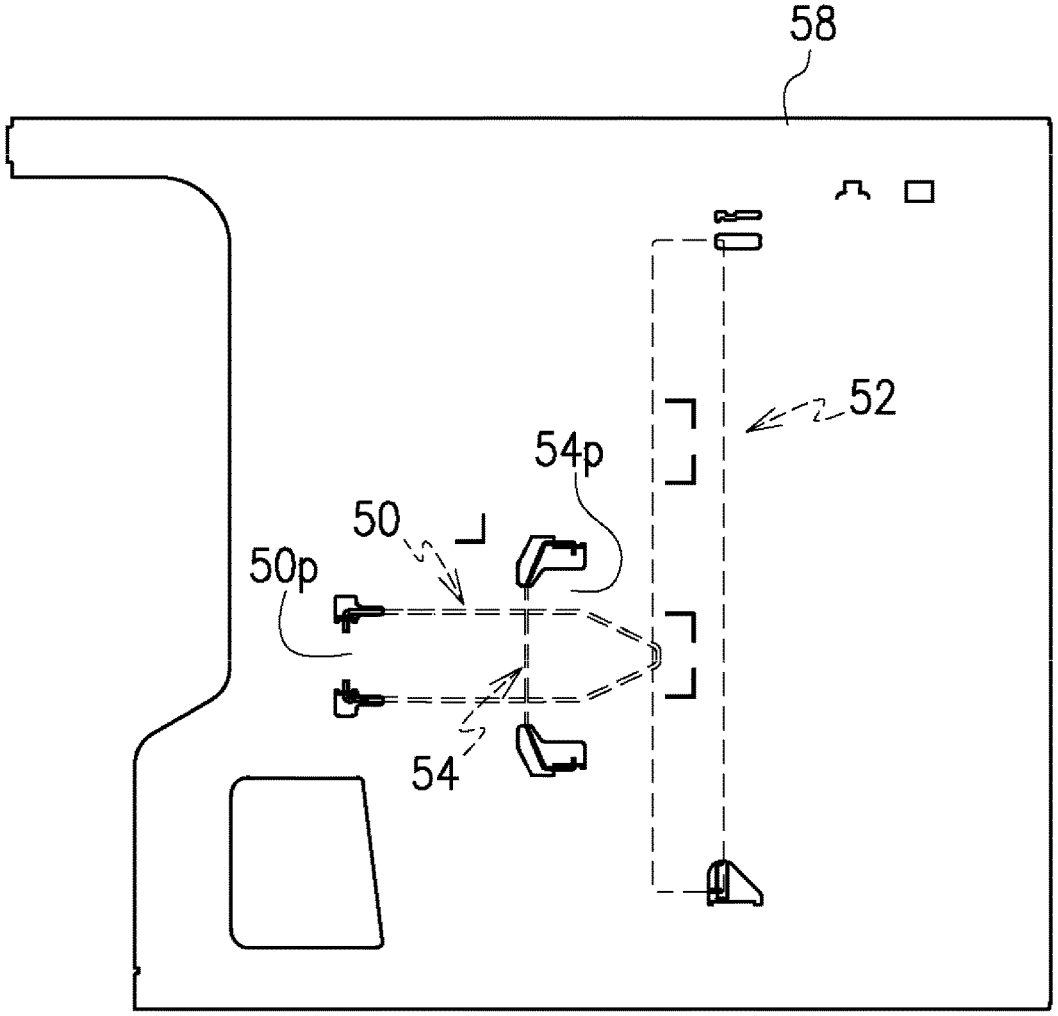
FIG. 5 is a top view illustrating an upper plate on which the detecting mechanism in the sheet feeding apparatus according to the present invention is provided.
Figure 6A:
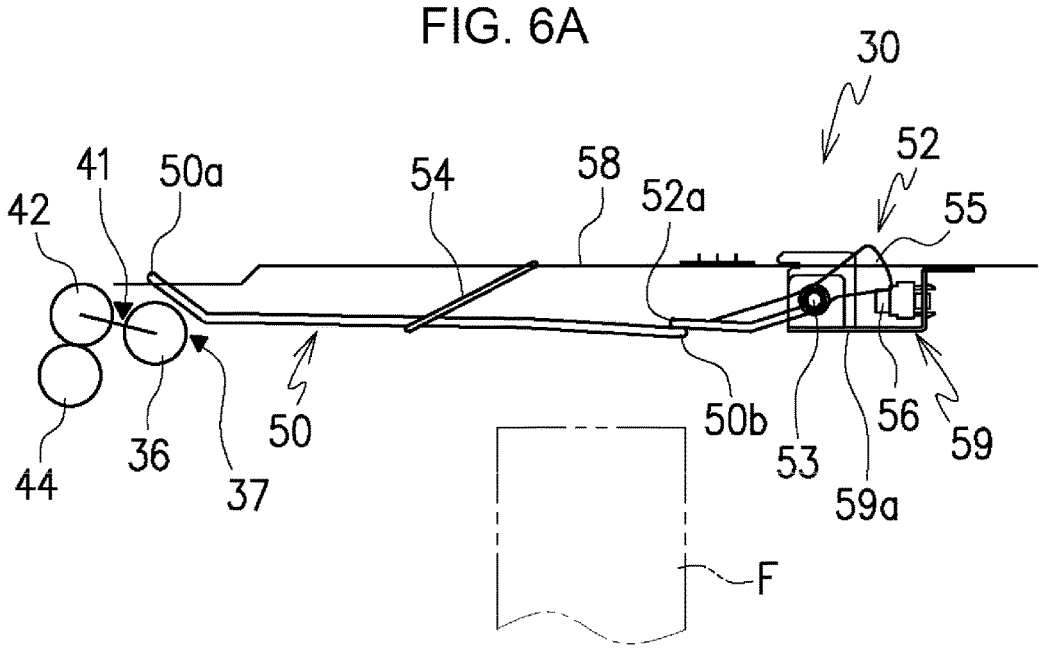
FIGS. 6A and 6B are side views each explaining the operation of the detecting mechanism of the sheet feeding apparatus according to the present invention.
Figure 6B:
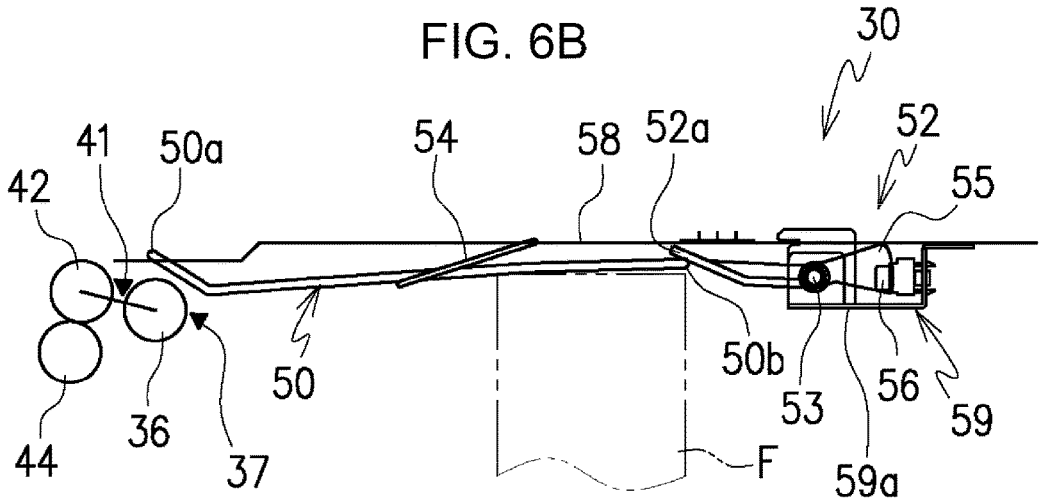

FIG. 4 is a bottom view of the upper plate 58 in the sheet feeding apparatus 14 provided with the detecting mechanism 30. FIG. 5 is a top view of the upper plate 58. FIGS. 6A and 6B are views for explaining the operation of the detecting mechanism 30 in which FIG. 6A illustrates a state before the foreign matter F is detected, and FIG. 6B illustrates a state after the foreign matter F has been detected. The first swing member 50 is moved at least partially when the foreign matter is lifted beyond a predetermined position. For example, the first swing member 50 is swung due to abutment with the sheet S or an object (foreign matter F).

The second swing member 52 is moved at least partially in conjunction with movement of the first swing member 50. For example, the second swing member 52 is swung due to abutment with the sheet S or an object (foreign matter F) and in conjunction with the swinging of the first swing member 50. The regulating member 54 is provided so as to regulate lowering of the first swing member 50 from a predetermined position. The regulating member 54 can be moved up together with the first swing member 50. The detecting sensor 56 detects movement of the second swing member 52. For example, the detecting sensor 56 detects swinging of the second swing member 52.

The operation of the detecting mechanism 30 will be described in detail. The first swing member 50 is partially moved up with upward movement of the foreign matter F. More specifically, with the upward movement of the foreign matter F, the first swing member 50 is rotated upward within a certain angle range about a rotary shaft provided in one end part 50*a*. The first swing member 50 is turnably axially supported at the one end part 50*a*, and the other end part 50*b* thereof is a free end suspended downward. That is, the first swing member 50 has the axially supported one end part 50*a* and the other end part 50*b* which is a free end extending in the delivery direction of the sheet S from the one end part 50*a*. The first swing member 50 has a V-shaped, U-shaped, or laid-down U-shaped bar-like member (wire, etc.) having an opening part 50*p*. Thus, the first swing member 50 can be widened in its detection range and can have a light-weight and rigid structure.

In the opening part 50*p*, end portions of the bar-like member protrude so as to be opposed to each other, and the protruding portions serve as the rotary shaft. Thus, it is possible to easily produce the first swing member 50 capable of smoothly rotating. Further, as illustrated in FIGS. 3 and 6A and 6B, the bar-like member constituting the first swing member 50 has a V shape as viewed from the side. Thus, even when the first swing member 50 is rotated upward about the rotary shaft (i.e., one end part 50*a*), no much space is taken for the rotation.

As illustrated in FIGS. 4 and 5, the first swing member 50 is fixed to the upper plate 58 with the opposing rotary shafts provided at the one end part 50*a* (opening 50*p* side end part) inserted into mounting parts formed by bending upward the upper plate 58 provided above the loading tray 28. With this configuration, the first swing member 50 can be rotated within a certain angle range with the one end part 50*a* as the rotary shaft. The other end part 50*b* of the first swing member 50 on the side opposite to the one end part 50*a* is a free end. The first swing member 50 is fixed to the upper plate 58 such that the other end part 50*b* is suspended by its own weight with the one end part 50*a* as a fulcrum. The first swing member 50 may be a plate-like member, and a plurality of first swing members 50 may be provided in the width direction of the sheet S.

The second swing member 52 is rotated in conjunction with upward rotation of the first swing member 50. For example, one end part 52*a* of the second swing member 52 is turnably axially supported, and the other end part 52*b* is a free end suspended downward. The first swing member 50 functions as a second regulating member 50 that regulates movement of the suspended second swing member 52 at a predetermined position. That is, the second swing member 52 has the axially supported one end part 52*a* and the other end part 52*b* which is a free end extending in the delivery direction of the sheet S from the one end part 52*a*. The first and second swing members 50 and 52 are disposed such that the one end part 52*a* of the second swing member 52 overlaps the other end part 50*b* of the first swing member 50 as viewed from above.

The second swing member 52 is provided with a rotary shaft 53 and a sensor flag 55. The second swing member 52 has the first end part 52*a* and the second end part 52*b* positioned on the side opposite to the first end part 52*a* with the rotary shaft 53 interposed therebetween. The sensor flag 55 is provided at the second end part 52*b*. The first end part 52*a* is rotated upward within a certain angle range in conjunction with upward movement of the first swing member 50. The sensor flag 55 is rotated downward in a certain angle range in conjunction with the upward movement of the first swing member 50. The detecting sensor 56 detects upward movement of the first end part 52*a* of the second swing member 52, i.e., downward rotation of the sensor flag 55.

The second swing member 52 is formed of a resin plate-like member elongated in the width direction of the sheet S. When the detecting mechanism 30 is not activated, the second swing member 52 is put in a state where the first end part 52*a* is positioned downward, and the sensor flag 55 is positioned upward so as not to be detected by the sensor 56, as illustrated in FIG. 2. The second swing member 52 is fixed to the upper plate 58 at a support part 52*d*. As illustrated in FIGS. 4 and 5, the both ends of the rotary shaft 53 are inserted into mounting parts formed by bending the upper plate 58 downward. With this configuration, the second swing member 52 can be rotated within a certain angle range about the rotary shaft 53.

As illustrated in FIGS. 6A and 6B, the sensor flag 55 has a fan-shaped part. As illustrated in FIG. 3 and FIGS. 6A and 6B, the sensor 56 is mounted to a bracket 59 fixed to the upper plate 58. A part of the bracket 59 extends up to a portion below the second swing member 52, and the extending part serves as a regulating part 59*a* for regulating an excessive downward rotation of the first end part 52*a*. The detecting sensor 56 is provided on the rotation track of the sensor flag 55. As illustrated in FIG. 3, the detecting sensor 56 has a U shape (left-opened U-shape in FIG. 3) in which a light-emitting element and a light-receiving element face each other. When the sensor flag 55 enters between the light-emitting element and the light-receiving element to interrupt light emitting from the light-emitting section to the light-receiving section, the detecting sensor 56 detects rotation of the second swing member 52.

The first end part (contact part) 52*a* of the second swing member 52 and the other end part (contact part) 50*b* of the first swing member 50 are moved up in conjunction with each other. In the present embodiment, the first end part 52*a* of the second swing member 52 is placed on the other end part 50*b* of the first swing member 50. That is, when the first swing member 50 is moved up, the other end part 50*b* of the first swing member 50 contacts and moves up the first end part 52*a* of the second swing member 52. The mechanism for moving up the second swing member 52 together with the first swing member 50 is not limited to the above configuration where the first end part 52*a* of the second swing member 52 is placed on the other end part 50*b* of the first swing member 50. For example, a link mechanism may be adopted, in which a shaft is inserted through elongated holes formed in the other end part 50*b* of the first swing member 50 and the first end part 52*a* of the second swing member 52 to link upward and downward movement between the first and second swing members 50 and 52.

The regulating member 54 regulates downward movement of the second swing member 52 at a position higher than the delivery position at which the sheet S is delivered by the delivery roller 36. The regulating member 54 regulates movement of the suspended first swing member 50 at a predetermined position. The regulating member 54 that regulates movement of the first swing member 50 also serves as the third swing member extending in a direction crossing the delivery direction of the sheet S. The regulating member 54 is swung due to abutment with the sheet S or an object (foreign matter F) to contact and swing the first swing member 50.

In the present embodiment, the regulating member 54 is formed of a bar-like member (wire, etc.) rotated within a certain angle range about an opening part 54*p*. The bar-like member supports the first swing member 50 from below. As illustrated in FIG. 4 to FIGS. 6A and 6B, the third swing member 54 is fixed at an acute angle toward the front of the upper plate 58 with both ends of the opening part 54*p* rotatably fixed to the upper plate 58. When the third swing member 54 is lifted by the foreign matter F and moved up while being rotated, the first swing member 50 is also moved up while being rotated. Accordingly, the second swing member 52 is also moved up while being rotated, and the sensor flag is also moved down while being rotated. Thus, the downward movement of the sensor flag 55 is detected by the sensor 56.

With reference to FIGS. 6A and 6B, a mechanism to detect the foreign matter F will be described. When the loading tray 28 is lifted in a state where the sheet S is not loaded on an appropriate position of the loading tray 28 or where an object other than the sheet S, i.e., the foreign matter F is placed on the loading tray 28 (FIG. 6A), the foreign matter F contacts at least one of the first swing member 50, the second swing member 52, and the regulating member 54. When the foreign matter F contacts the first swing member 50 to rotate the first swing member 50 so as to move up the other end part 50*b* thereof (FIG. 6A), the second swing member 52 is also rotated so as to move up the first end part 52*a*, and the downward movement of the sensor flag 55 is detected by the detecting sensor 56. Based on a detection signal from the detecting sensor 56, the control section stops lifting of the loading tray 28.

When the foreign matter F contacts the second swing member 52 to rotate the second swing member 52 so as to move up the first end part 52*a*, the sensor flag 55 is rotated downward, and the downward movement of the sensor flag 55 is detected by the detecting sensor 56. Based on a detection signal from the detecting sensor 56, the control section stops lifting of the loading tray 28. When the foreign matter F contacts the regulating member 54 to rotate it upward, downward movement of the sensor flag 55 is detected by the detecting sensor 56 through rotations of the respective first and second swing members 50 and 52, as described above. Based on a detection signal from the detecting sensor 56, the control section stops lifting of the loading tray 28. In this manner, the foreign matter F in the loading tray 28 is detected by the detecting mechanism 30, and the lifting of the loading tray 28 is stopped. That is, the sheet feeding apparatus 14 stops the lifting mechanism 70 according to a detection result from the detecting sensor 56.

The delivery roller 36, the first swing member 50, the second swing member 52, and the regulating member 54 are arranged such that the sheet S of an intended size loaded on an appropriate position or foreign matter F contacts at least one of the delivery roller 36, the first swing member 50, the second swing member 52, and the regulating member 54 when the loading tray 28 is lifted. In the present embodiment, the delivery roller 36 is disposed frontmost, and the first swing member 50 is disposed at the rear of the delivery roller 36. The regulating member 54 is disposed in the middle of the first swing member 50 in the front-rear direction so as to overlap the first swing member 50. The second swing member 52 is disposed at the rear of the first swing member 50 such that the first end part 52*a* of the second swing member 52 overlaps the other end part 50*b* of the first swing member 50 from above.

In the present embodiment, the length of the first swing member 50 from the one end part 50*a* to the other end part 50*b* is made larger than the length of the second swing member 52 from the first end part 52*a* to second end part 52*b*. The length of the first swing member 50 from the one end part 50*a* to the other end part 50*b* refers to the horizontal distance of the first swing member 50 in the front-rear direction in a state where the detecting mechanism 30 is not activated. Similarly, the length of the second swing member 52 from the first end part 52*a* to the second end part 52*b* refers to the horizontal distance of the second swing member 52 in the front-rear direction in a state where the detecting mechanism 30 is not activated. In other words, the length of the second swing member 52 in the delivery direction is made smaller than the length of the first swing member 50 in the delivery direction.

Figure 7A:
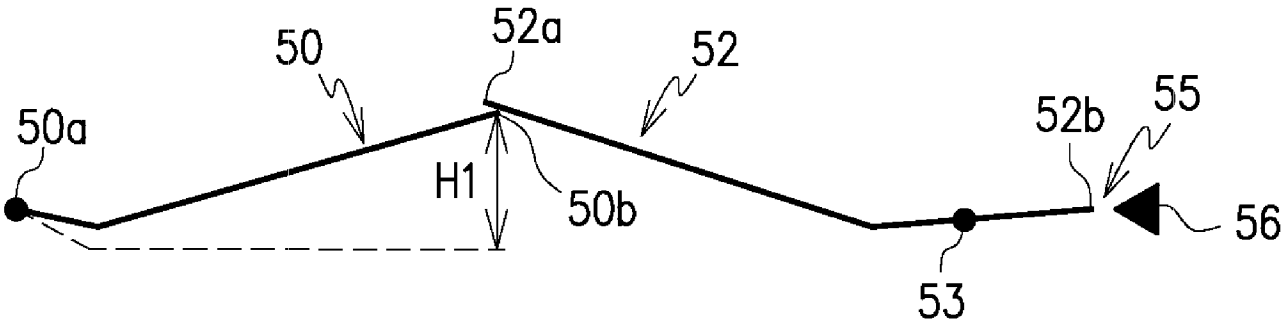
FIGS. 7A and 7B are schematic views for explaining the configuration of the detecting mechanism of the sheet feeding apparatus according to the present invention.
Figure 7B:
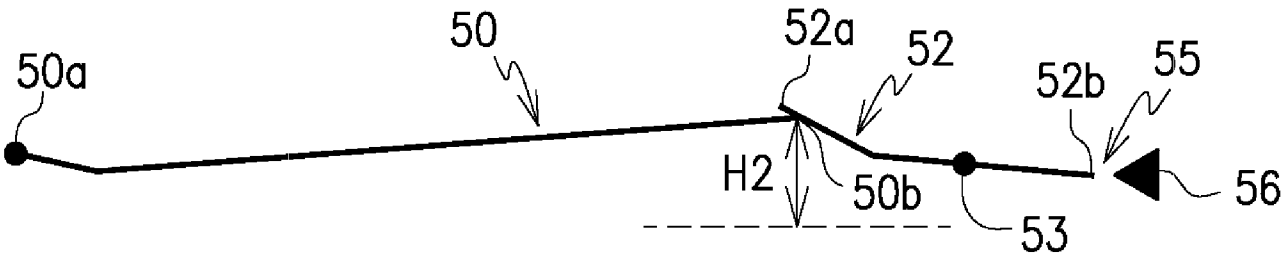

As illustrated in FIG. 7A, when the length of the first swing member 50 from the one end part 50*a* to the other end part 50*b* is smaller than the length of the second swing member 52 from the first end part 52*a* to the second end part 52*b*, it is necessary to lift the one end part 52*a* of the second swing member 52 as high as a height H1 in order for the sensor flag 55 to be detected by the detecting sensor 56, so that an installation space for the detecting mechanism 30 is disadvantageously increased. On the other hand, as illustrated in FIG. 7B, when the length of the first swing member 50 from the one end part 50*a* to the other end part 50*b* is larger than the length of the second swing member 52 from the first end part 52*a* to the second end part 52*b*, it is sufficient to lift the one end part 52*a* of the second swing member 52 by a height H2 which is lower than the height H1 in order for the sensor flag 55 to be detected by the detecting sensor 56, so that the installation space of the detecting mechanism 30 can be made small.

Operation of the loading tray 28 will be described based on the flowchart of FIG. 8. A storage 60 is pulled out to set sheets on the loading tray 28, and the storage 60 is attached to the sheet feeding apparatus 14. Then, an attachment sensor is activated (ON), a lifting motor (not illustrated) is driven, and the loading tray 28 on which the sheets S are loaded is lifted. When the uppermost sheet S contacts the delivery roller 36, the delivery position detecting sensor 37 is activated (ON). Then, the loading tray 28 is lifted further by a predetermined amount, and the lifting of the loading tray 28 is stopped after the uppermost sheet S is moved to the delivery position.

When the delivery position detecting sensor 37 is not activated even after the lifting of the loading tray 28, but, instead, the upper limit detecting sensor 41 is activated (ON), it is determined that the delivery position detecting sensor 37 cannot detect the uppermost sheet S due to a failure thereof even though the uppermost sheet S contacts the delivery roller 36, and the lifting of the loading tray 28 is stopped. This can prevent breakage of the sheet feeding apparatus 14.

Figure 8:
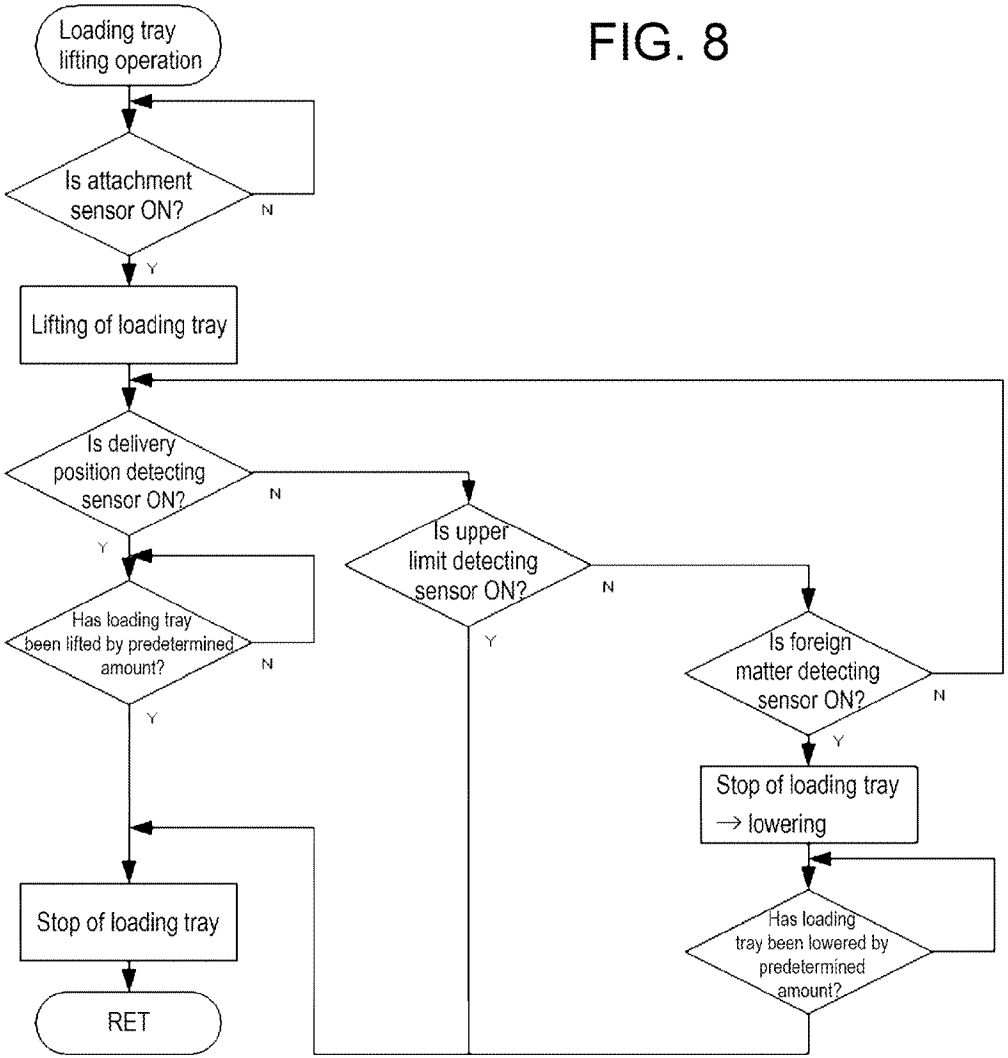
FIG. 8 is an operation flowchart illustrating the operation of a loading tray of the sheet feeding apparatus according to the present invention.

As illustrated in FIG. 8, when the delivery position detecting sensor 37 and the upper limit detecting sensor 41 are not activated even after the lifting of the loading tray 28, but, instead, the sensor 56 (foreign matter detecting sensor) is activated (ON), it is determined that the foreign matter F is present in the loading tray 28, and the lifting of the loading tray 28 is stopped. Thereafter, the loading tray 28 is lowered by a predetermined amount and is then stopped once again. The predetermined lowering amount is set to a distance larger than the distance between the upper end of the storage 60 and the lowermost position of the second swing member 52 in order to return the sheets that have exceeded the upper end of the storage 60 inside the storage 60.

In the above embodiment, when the presence of the foreign matter F is determined, the loading tray 28 is lowered by a predetermined amount. However, the type of the foreign matter F is not known. Thus, when the sheet feeding apparatus 14 is made to perform some action (lowering of the loading tray 28, etc.) without confirming the type of the foreign matter F, serious breakage of the sheet feeding apparatus 14 may be caused. In such a case, the control section performs processing so as not to allow a user of the image formation processing system 100 to recover the sheet feeding apparatus 14 but to allow only an administrator or a repair agent to recover the sheet feeding apparatus 14.

Figure 9C:
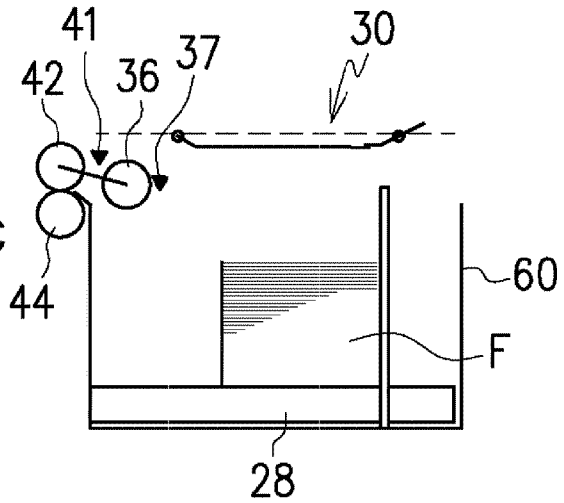
Figure 9D:
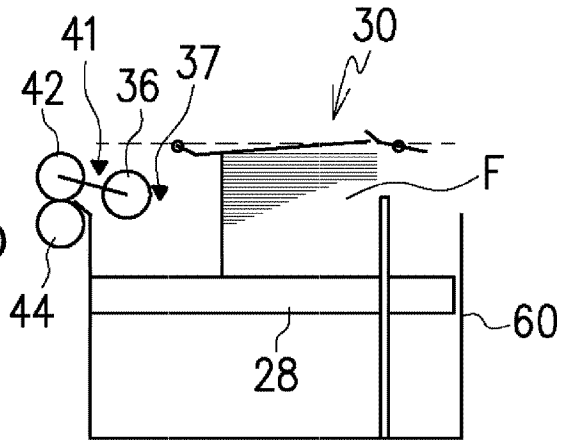
Figure 9A:
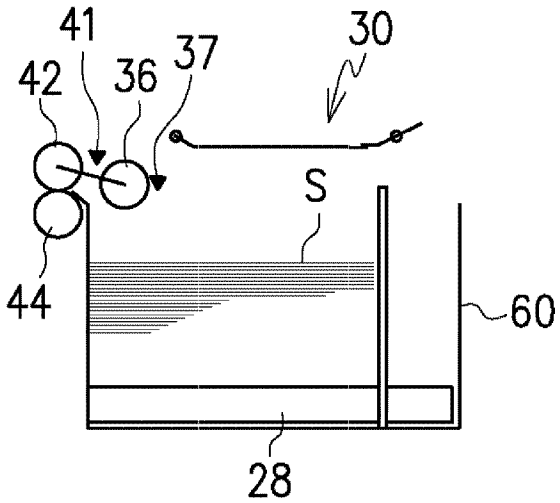
Figure 9B:
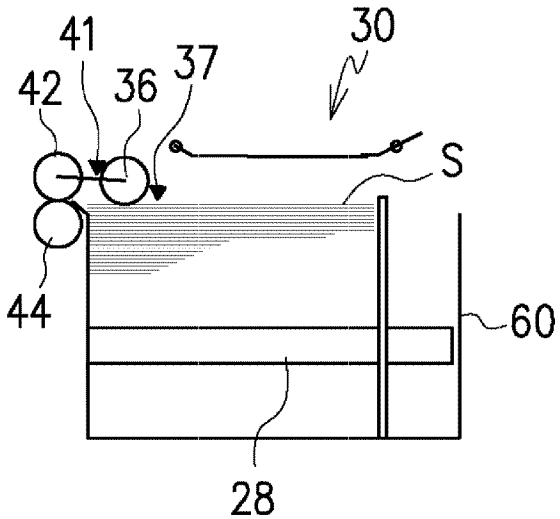

With reference to FIGS. 9A to 9D and FIGS. 10E and 10F, an operation from the start of lifting of the loading tray 28 on which the sheets S are loaded at an appropriate set position to the start of delivery of the sheets S from the loading tray 28 by the delivery roller 36 and an operation in which the foreign matter F loaded on the loading tray 28 is detected by the detecting mechanism 30 will be described. FIG. 9A illustrates a state where the loading tray 28 on which appropriate sheets S are loaded is lifted. When the loading tray 28 is further lifted in this state, the sheets S contact the delivery roller 36 as illustrated in FIG. 9B, and the delivery position detecting sensor 37 detects the contact. Then, the loading tray 28 is lifted by a predetermined amount and is stopped when the sheet upper surface reaches the delivery position.

FIG. 9C illustrates a state where the loading tray 28 on which a sheet bundle F of a size smaller than a proper size is set at a wrong position is lifted. When the loading tray 28 is further lifted in this state, the sheet bundle F contacts the detecting mechanism 30 without contacting the delivery roller 36, that is, without being detected by the delivery position detecting sensor 37 and the upper limit detecting sensor 41, as illustrated in FIG. 9D. Thus, abnormality is detected by the detecting mechanism 30, and the loading tray 28 is stopped.

Figure 10E:
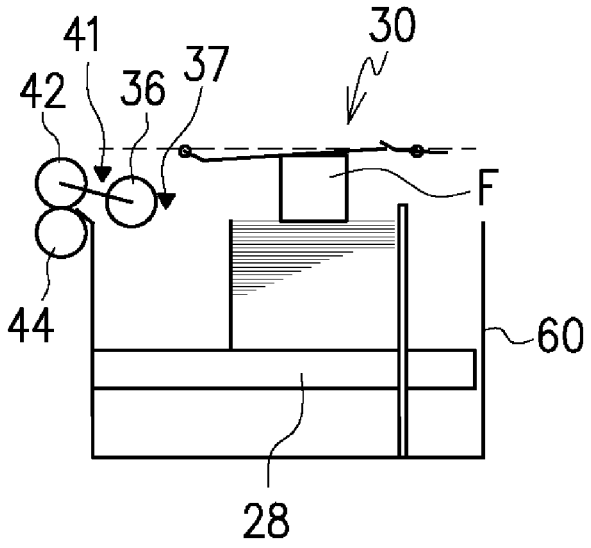
FIGS. 10E and 10F are views each illustrating a state where the detecting mechanism of the sheet feeding apparatus according to the present invention detects a foreign matter.
Figure 10F:
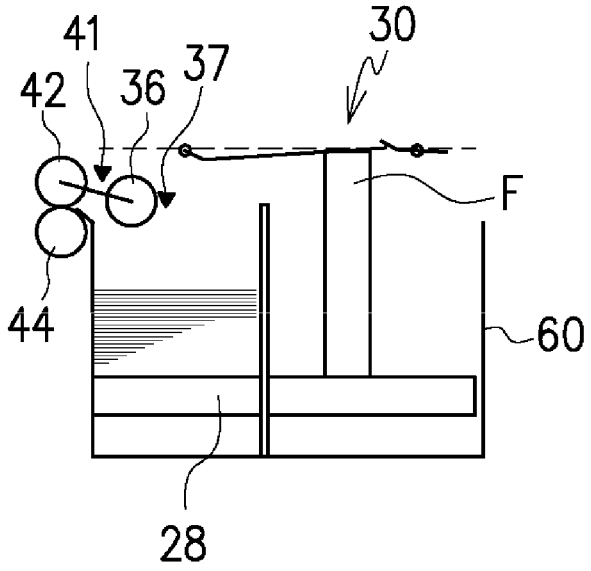

FIG. 10E illustrates a state where a foreign matter F placed on a sheet bundle contacts the detecting mechanism 30. At this time, as well, the foreign matter F contacts the detecting mechanism 30 without being detected by the delivery position detecting sensor 37 and the upper limit detecting sensor 41. Thus, abnormality is detected by the detecting mechanism 30, and the loading tray 28 is stopped. FIG. 10F illustrates a state where a foreign matter F placed at the rear of a rear end regulating plate of the loading tray 28 contacts the detecting mechanism 30. At this time, as well, the foreign matter F contacts the detecting mechanism 30 without being detected by the delivery position detecting sensor 37 and the upper limit detecting sensor 41. Thus, abnormality is detected by the detecting mechanism 30, and the loading tray 28 is stopped.

This application is based upon and claims the benefit of priority from prior Japanese Patent Application No. 2016-251779, filed Dec. 26, 2016, the entire contents of which are incorporated herein by reference.

What is claimed is:

1. A sheet feeding apparatus that feeds a sheet, comprising:

a loading section on which a sheet is loaded;

a lifting section that lifts and lowers the loading section;

a sheet feeding section that delivers the sheet moved to a delivery position through lifting of the loading section; and a detecting mechanism that detects lifting of the sheet or an object on the loading section beyond the delivery position, wherein the detecting mechanism includes a first swing member disposed above the delivery position and configured to be swung in a vertical direction and a second swing member disposed above the delivery position and configured to be swung in conjunction with the swinging of the first swing member, and a detection sensor to detect swinging of the second swing member, the second swing member has a length in a sheet feeding direction, which is shorter than a length of the first swing member in the sheet feeding direction, and the second swing member has a length in a sheet width direction, which is longer than a length of the first swing member in the sheet width direction.

2. The sheet feeding apparatus according to claim 1, wherein the first swing member is provided so as to extend in the sheet feeding direction and has a swing fulcrum and a contact part, the swing fulcrum being provided at an end portion thereof on a downstream side in the sheet feeding direction, the contact part being formed at an end portion thereof on an upstream side in the sheet feeding direction and configured to contact and swing the second swing member.

3. The sheet feeding apparatus according to claim 2, wherein the first swing member is disposed above a center portion of the sheet in the sheet width direction crossing the sheet feeding direction.

4. The sheet feeding apparatus according to claim 2, wherein the second swing member is provided so as to extend in the sheet width direction crossing the sheet feeding direction and has a swing fulcrum and a contact part, the swing fulcrum being provided at an end portion thereof on the upstream side in the sheet feeding direction, the contact part being formed at an end portion thereof on the downstream side in the sheet feeding direction and configured to contact the first swing member.

5. The sheet feeding apparatus according to claim 1, wherein the detecting mechanism has a first regulating member that regulates a swinging range of the first swing member, and a second regulating member that regulates a swinging range of the second swing member.

6. The sheet feeding apparatus according to claim 1, wherein the first swing member is disposed downstream of the second swing member in the sheet feeding direction.

7. The sheet feeding apparatus according to claim 1, further comprising a storage having therein the loading tray and configured to store the sheet on the loading tray, wherein the first and second swing members are disposed above the storage.

8. A sheet feeding apparatus that feeds a sheet, comprising:

a loading tray on which a sheet is loaded;

a sheet feeding section that abuts against the sheet at a delivery position and delivers the sheet at the delivery position;

a sheet upper surface detecting section that detects an uppermost surface of the sheet on the loading tray;

a lifting section that lifts the loading tray; and a detecting section disposed above the sheet upper surface detecting section and configured to detect the sheet or an object on the loading tray moved beyond the delivery position, and having a first swing member that is swung upon contact with the sheet or object, a second swing member that is swung due to contact with the sheet or object and in conjunction with the swinging of the first swing member, and a detecting sensor that detects swinging of the second swing member, wherein the lifting section lifts by a predetermined amount the loading tray based on a detection of the sheet upper surface by the sheet upper surface detecting section to move the uppermost surface of the sheet to the delivery position, and lowers by a predetermined amount based on the detection of swinging of the second swing member.

9. The sheet feeding apparatus according to claim 8, further comprising an upper limit detection section to detect when the uppermost surface of the sheet on the loading tray is lifted at a predetermined position beyond the delivery position, wherein the lifting section stops lifting of the loading tray on a detection of reaching the predetermined position of the uppermost surface of the sheet by the upper limit detection section.

* * * * *